US006578750B2

(12) United States Patent
Kubo et al.

(10) Patent No.: US 6,578,750 B2
(45) Date of Patent: Jun. 17, 2003

(54) NAIL HAMMERING GUIDE MECHANISM IN NAILING MACHINE

(75) Inventors: Kouji Kubo, Tokyo (JP); Takayuki Masuno, Tokyo (JP); Takao Tsukada, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/143,774

(22) Filed: May 14, 2002

(65) Prior Publication Data

US 2002/0185515 A1 Dec. 12, 2002

(30) Foreign Application Priority Data

May 16, 2001 (JP) ..... 2001-146923

(51) Int. Cl.[7] ..... B25C 1/04

(52) U.S. Cl. ..... 227/142; 227/8

(58) Field of Search ..... 227/120, 142, 227/8, 130

(56) References Cited

U.S. PATENT DOCUMENTS

| | | | | | |
|---|---|---|---|---|---|
| 4,821,937 | A | * | 4/1989 | Rafferty | 227/8 |
| 5,715,982 | A | * | 2/1998 | Adachi | 227/130 |
| 5,785,227 | A | * | 7/1998 | Akiba | 227/142 |
| 6,024,267 | A | * | 2/2000 | Chen | 227/142 |
| 6,145,727 | A | * | 11/2000 | Mukoyama et al. | 227/8 |

* cited by examiner

*Primary Examiner*—Scott A. Smith
(74) *Attorney, Agent, or Firm*—Morgan, Lewis & Bockius LLP

(57) ABSTRACT

A contact mechanism includes a contact top disposed on an outer peripheral portion of a leading end portion of a nose in such a manner that it is slidable along an axial direction of the nose, and a hollow nose top held by the contact top and including an ejection opening formed in front of an ejection opening formed in the nose in such a manner that the ejection opening of the nose top is connected continuously with the ejection opening of the nose. The contact top is connected to an adjuster mechanism through a contact arm and, at the same time, the contact top can be guided by the outer peripheral surface of the leading end portion of the nose.

5 Claims, 7 Drawing Sheets

NAIL HAMMERING GUIDE MECHANISM IN NAILING MACHINE

BACKGROUND OF THE INVENTION

1. Field of the Invention

The present invention relates to a nailing machine which, using a driver to be driven impactively due to power such as compressed air, hammers a nail supplied into an ejection opening of a nose therefrom into a member to be nailed and, in particular, to a nail hammering guide mechanism for positively guiding the nail to be hammered out from the ejection opening into the member to be nailed using the driver.

2. Description of the Related Art

As an example of a conventional guide mechanism for use in a nailing machine, description will be given below of a structure of a nailing machine using compressed air as a power source with reference to FIG. 7. In the present nailing machine, a drive piston 2 is slidably stored in a drive cylinder 1 disposed in the interior portion of a nailing machine body, and a drive driver 3 is stored in the interior portion of a nose 4 which extends in the lower surface direction of the piston 2 and is mounted in the lower portion of the nailing machine body. The hollow cylindrical-shaped nose 4 forming an ejection opening includes an opening formed in the side surface thereof; and, through the opening, connected nails stored within a magazine 5 can be supplied into the ejection opening by a nail supply mechanism. As the drive piston 2 is driven, the drive driver 3 hammers the nail supplied into the ejection opening of the nose 4 toward a member to be nailed. On the upper end portion of the drive cylinder 1, there is disposed a main valve 6 which is used to introduce compressed air within a chamber formed in the body into the drive cylinder 1. In operation, in the case where a manually-operatable trigger valve 7 is operated by hand, the main valve 6 is opened and closed to introduce the compressed air into the drive cylinder 1, thereby driving the drive piston 2.

On the leading end portion of the nose 4 including the ejection opening, there is disposed a contact member 8 which can be operated when it is contacted with the member to be nailed. In the case where not only the contact member 8 is contacted with the member to be nailed and is thereby operated but also a trigger lever 9 disposed on the base of a grip portion is manually operated, the trigger valve 7 can be operated and started. In other words, the trigger valve 7 and trigger lever 9 are arranged so as to cooperate together in forming a safety mechanism which can prevent the trigger valve 7 from being operated unexpectedly.

In the nailing machine which drives the driver impactively to hammer the nails in the above-mentioned manner, there occurs a reaction phenomenon in which the nailing machine body jumps upwardly as a result of the reaction of the operation of the driver. In this case, due to this reaction phenomenon, the nose 4 is moved upwardly, the nail ejection opening is moved apart from the surface of the member to be nailed, and the driver hammering the head of the nail is removed from the head of the nail to hammer. As a result, the driver hammers the surface of the member to be nailed to thereby damage the same. That is, the reaction phenomenon gives rise to a problem that the driver misses the correct mark but hammers the wrong one. To cope with such wrong mark hammering of the driver, the nose including the ejection opening is divided as a nose top member forming an ejection opening, and the contact member is used in combination with the nose top member forming the ejection opening of the nose. That is, even in the case where the nailing machine body and the nose are moved upwardly due to the reaction phenomenon, the nose top member can be kept in contact with the surface of the member to be nailed to thereby prevent the occurrence of the wrong mark hammering of the driver.

Further, in the conventional nailing machine, there is disposed an adjuster mechanism which is capable of varying the position of the top dead center of the contact member contactable with the member to be nailed to thereby adjust the projecting length of the driver from the nose and thus adjust the depth of the nail to be hammered in. However, in the case of this adjuster mechanism, there is a tendency to set large the amount of adjustment to be made by this adjuster mechanism in order to be able to cover a wide variety of members to be nailed ranging from relatively soft members to hard ones, or in order to be able to expand the range of nail sizes that can be used.

The conventional contact member is structured in the following manner. An enlarged-diameter portion 10 is formed in the leading end portion of the nose 4, and a nose top 8 forming the leading end portion of the ejection opening is slidably stored in the interior of the enlarged-diameter portion 10. The outer peripheral portion of the upper portion of the nose top 8 is formed in a dual-structure bag shape to enclose the enlarged-diameter portion 10 of the nose 4 from the outside thereof to thereby form a guide portion between the nose and the nose top. The upper end portion of the outer peripheral portion of the upper portion of the bag-shaped portion of the nose top 8 is connected to the lower end portion of a contact arm 11 which extends in the direction of the trigger lever 9.

In the above-mentioned conventional structure, however, the nose leading end portion provides a four-fold structure and thus the outside diameter D1 of the contact member becomes large. Accordingly, in order to reduce the total height of the nailing machine, the length dimension L1 of the leading-end-side small-diameter portion of the contact member becomes short, which makes it difficult to confirm visually the nail hammering portion, resulting in the worsened operation efficiency. Also, as shown in FIG. 8, in order to facilitate the visual observation of the nail hammering portion, in the case where the length dimension L2 of the above-mentioned leading end-side small-diameter portion is set long, the length of the driver must be enlarged in correspondence to the thus long-set length. Since the dimension L3 between the leading end of the driver at its waiting position and the head of the nail cannot be reduced, the total height of the nailing machine becomes large by twice as high as the dimension L2.

Further, in the conventional structure, in order to increase the adjustment amount to be set by the adjuster mechanism, there arises the need to set large the dimensions L4 of the two portions of the bag-shaped portion forming the guide portion between the contact member and nose, which makes it necessary to increase the total height of the nailing machine up to two times as high as the dimension that is obtained when the adjustment amount is increased. Such increase in the total height of the nailing machine causes the nailing machine to lose its balance and thus makes it difficult to handle the nailing machine, which increases the load that is applied to the wrist of an operator.

SUMMARY OF THE INVENTION

The present invention aims at eliminating the problems found in the conventional nailing machines. Accordingly, it is an object of the invention to provide a nailing machine including a nail hammering guide mechanism which can prevent the wrong mark hammering of the driver owing to the reactive motion of the nailing machine, can facilitate the visual confirmation of the hammering portion without increasing the outside diameter of the leading end portion of a contact member, and can set large the adjustment allowance of an adjuster mechanism without increasing the total height of the nailing machine.

In attaining the above object, according to a first aspect of the invention, there is provided a nail hammering guide mechanism in a nailing machine. The nailing machine comprises a nose including a nail ejection opening; a driver slidably disposed in an interior of the ejection opening of the nose for hammering a nail supplied into the ejection opening with a drive force such as compressed air; a contact mechanism disposed projectingly in front of the nose and operatable by contacting with a member to be nailed; and a manually operatable trigger lever, wherein the driver can be driven only through the operation of both the contact mechanism and the trigger lever. The contact mechanism includes a contact top disposed in the outer periphery of a leading end portion of the nose so as to be slidable along the axial direction of the nose; and a hollow nose top having an ejection opening so formed in front of the ejection opening of the nose as to be in communication with the ejection opening of the nose. The contact top is connected to an adjuster mechanism through a contact arm, and the contact top is guided by an outer peripheral surface of the leading end portion of the nose.

Also, according to a second aspect of the invention, there is formed guide means for slidingly guiding the nose and contact top along the axial direction of the nose between the outer peripheral surface of the leading end portion of the nose and the inner peripheral surface of the contact top in a nail hammering guide mechanism in a nailing machine as set forth in the first aspect of the invention.

Since the nose top including a nail ejection opening is disposed on the contact top which is energized so as to project in the leading end direction thereof, even in the case where the nailing machine is moved upwardly owing to its reaction to a hammering action of the driver, the nail ejection opening is closely contacted with the member to be nailed to thereby be able to prevent mutual slippage between the member to be nailed and driver, so that the wrong mark hammering of the driver can be prevented and thus the nails can be hammered flush with one another.

Also, even in the case where the adjustment amount of the adjuster mechanism is set large, there is no need to increase the length of the lower end of the nose and thus the total height of the nailing machine can be set small. Further, since the small-diameter straight portion of the leading end portion of the nose top can be set large, the visual confirmation of the nail hammering portion is facilitated.

Further, even in the case where the nail is hammered at a corner (obliquely hammered) while the adjustment amount of the adjuster mechanism is adjusted to the minimum, the hammering portion is easy to aim at and the nails can be prevented from falling down, so that the nails can be hammered deep into the member to be nailed.

According to the second aspect of the invention, since the contact top and nose top are slidingly guided by the guide projection and guide groove, there is no need to form a cylindrical-shaped guide portion in the outer peripheral surface of the leading end portion of the nose, so that this portion can be set small in dimension. Also, even if a contact top is formed so as to escape from the nail-pickup inclined surface formed in the lower end portion of the nose, the rickety motion of the contact top in the back-and-forth direction thereof can be prevented. This is advantageous not only in that the dimension of the lower portion of the nose can be reduced further but also in that the total height of the nailing machine can be set further smaller.

DETAILED DESCRIPTION OF THE PREFERRED EMBODIMENTS

Figure 1:
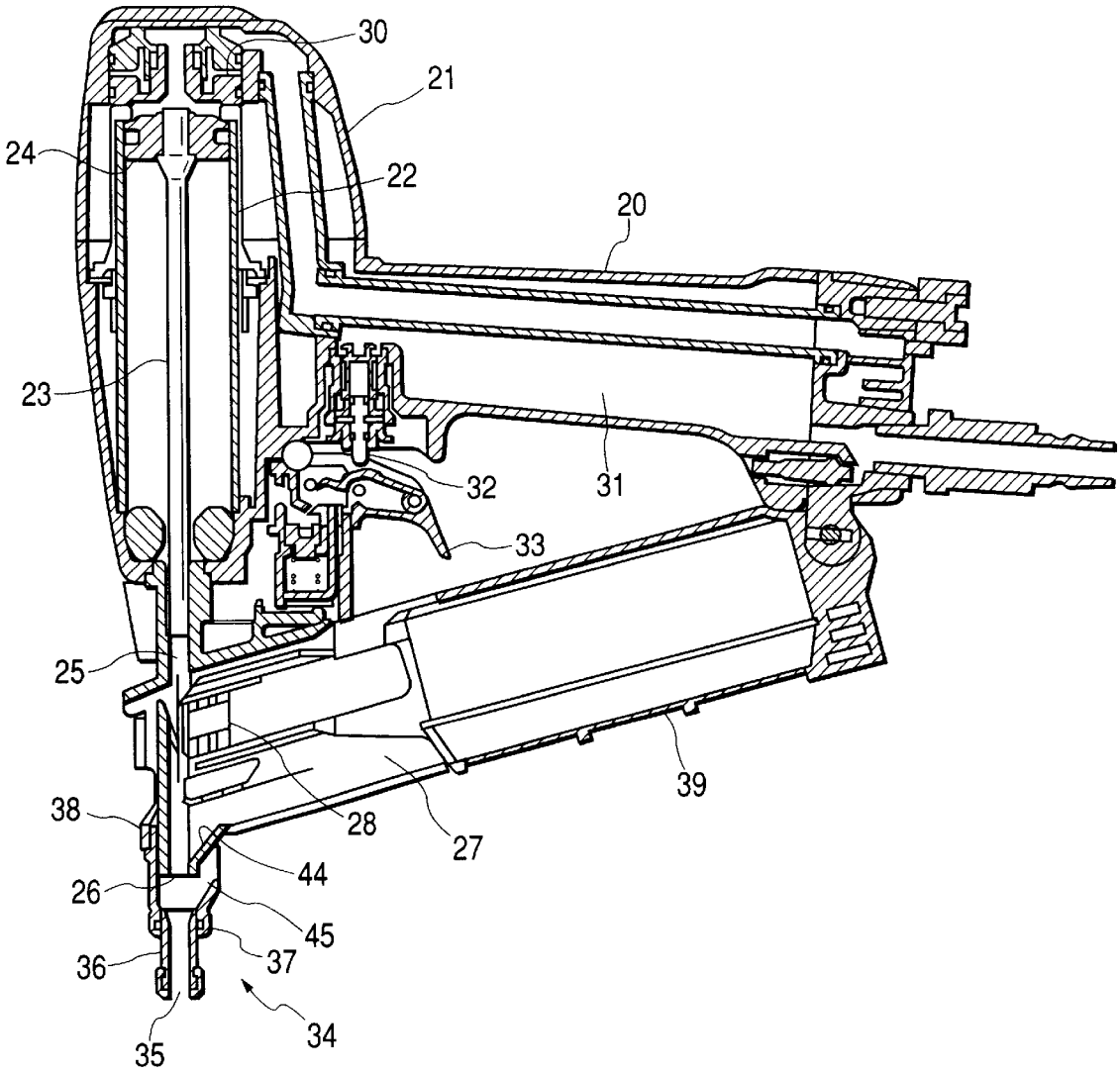
FIG. 1 is a longitudinal side view of a nailing machine incorporating therein an embodiment of a contact mechanism according to the invention.

Now, description will be given below of the mode for carrying out the invention with reference to an embodiment of a nail hammering guide mechanism in a nailing machine shown in the drawings. FIG. 1 shows a nailing machine including a nail hammering guide mechanism according to an embodiment of the present invention. In the nailing machine, a hammering cylinder 22 is disposed in a hollow housing 21 with a grip portion 20 formed integrally therewith. A hammering piston 24 is slidably stored in the interior of the hammering cylinder 22, and the lower surface of the hammering piston 24 is connected with a driver 23 for hammering a nail. On the lower portion of the housing 21, there is mounted a nose 26 including a hollow nail ejection opening 25, while the driver 23 is slidably guided into the nail ejection opening 25 of the nose 26. A nail supply guide 27 is disposed so as to be continuous with an opening formed in the side surface of the nail ejection opening 25 of the nose 26. A nail supply mechanism 28 is disposed along the nail supply guide 27, and connected nails stored within the magazine 29 can be supplied therefrom sequentially into the nail ejection opening 25 of the nose 26.

On the upper end of the hammering cylinder 22, there is disposed a main valve 30. The main valve 30 is used to connect the interior portion of the hammering cylinder 22 selectively to the interior portion of an air chamber 31 connected to a compressed sir supply source or to an air exhaust port. In the case where the main valve 30 connects the interior portion of the hammering cylinder 22 to the interior of the air chamber 31, the compressed air is introduced into the interior portion of the air chamber 31 to thereby drive the hammering piston 24. In the base portion of the grip portion 20, there is disposed a trigger valve 32 which is used to control the main valve 30. The trigger valve 32 cooperates together with a manually operatable trigger lever 33 and a contact mechanism 34 projectingly disposed in front of the nail ejection opening 25 of the nose 26 in order to constitute a safety mechanism. That is, the trigger valve 32 can be actuated through the safety mechanism which can be operated only through the operation of both of the trigger lever 33 and contact mechanism 34.

The contact mechanism 34 is composed of a hollow nose top 36 including a nail ejection opening connected so as to be continuous with the nail ejection opening 25 formed in the nose 26, and a contact top 37 for holding the nose top 36 so as to be slidable with respect to the nose 26. The upper end of a contact arm 38 connected to the contact top 37 is located in the vicinity of the trigger lever 33.

Figure 2:
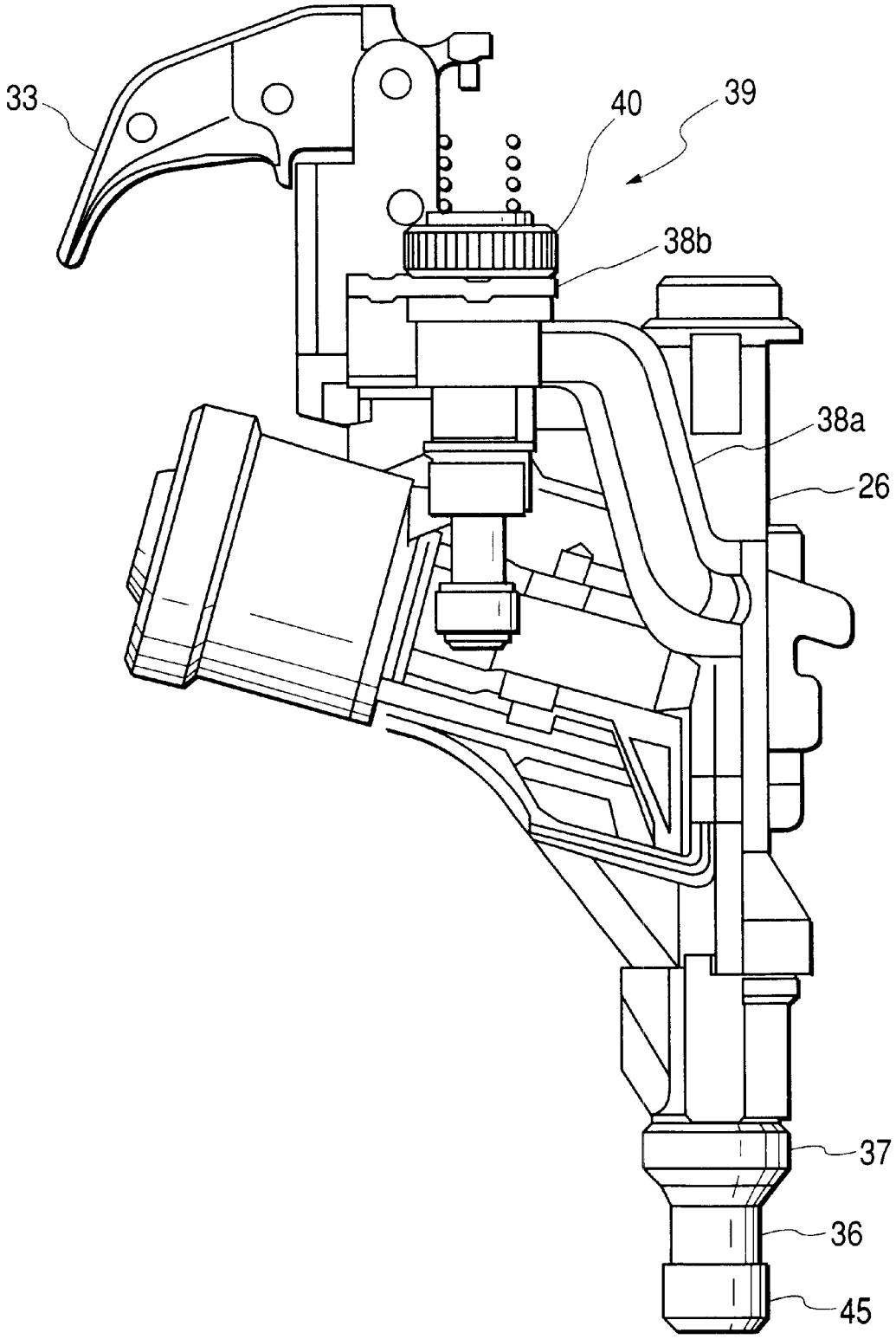
FIG. 2 is a side view of the details of the contact mechanism of the nailing machine shown in FIG. 1.
Figure 3:
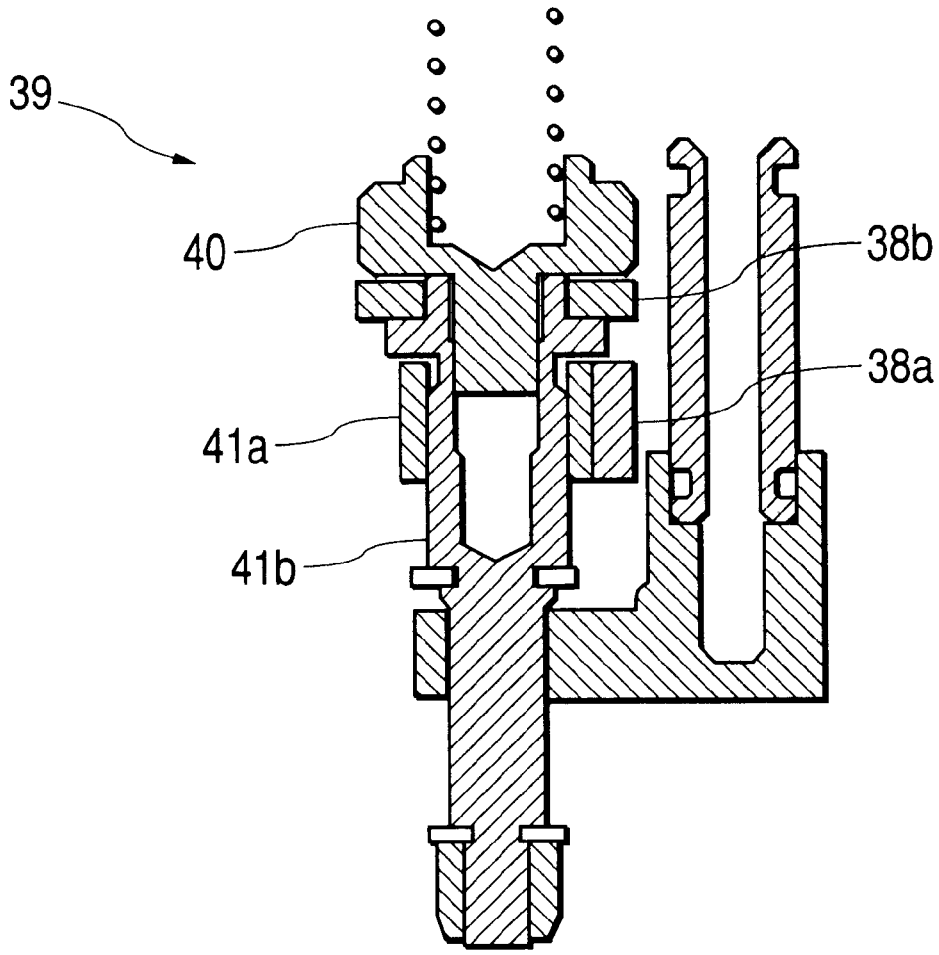
FIG. 3 is a front longitudinal-section view of the contact mechanism portion of the embodiment.

As shown in FIGS. 2 and 3, in the middle portion of the contact arm 38, there is disposed an adjuster mechanism 39. The contact arm 38 is divided into two sections by the adjuster mechanism 39. The leading-end-side lower arm portion 38*a* of the contact arm 38 can be moved along the nose 26 through a female screw 41*a* and a male screw 41*b* which can be respectively rotated by an adjusting dial 40, thereby being able to adjust variably the projecting amount of the nose top 36 with respect to the nose 26 in the leading end direction thereof. The upper end of an upper arm portion 38*b* of the contact arm 38 is disposed in the vicinity of the trigger lever 33. Only when the trigger lever 33 and the upper arm portion 38*b* of the contact arm are both operated at their respective operation positions, the trigger valve 32 can be operated and started.

Figure 4:
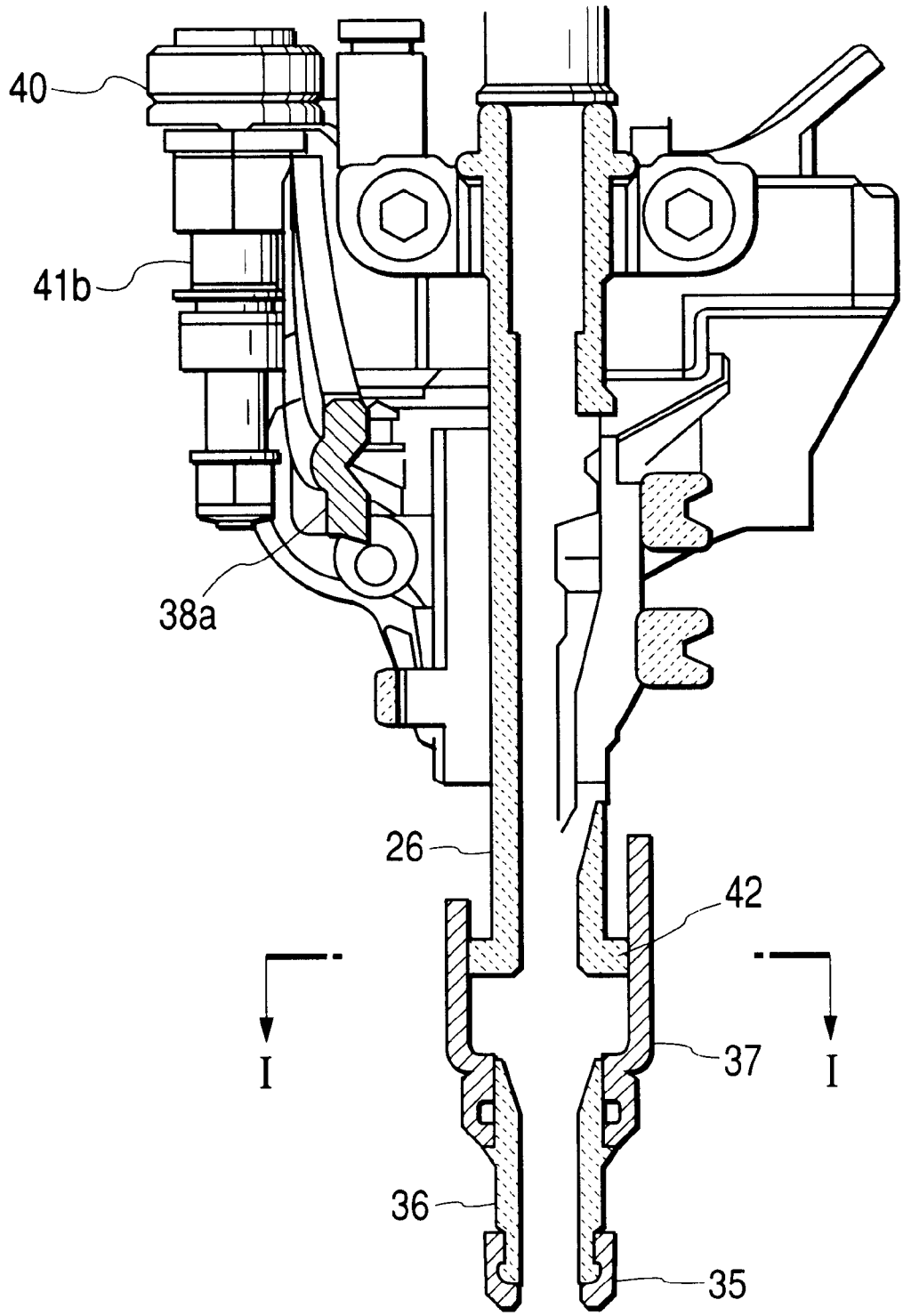
FIG. 4 is a section view of the contact mechanism, showing a state thereof in which it is operated.
Figure 5:
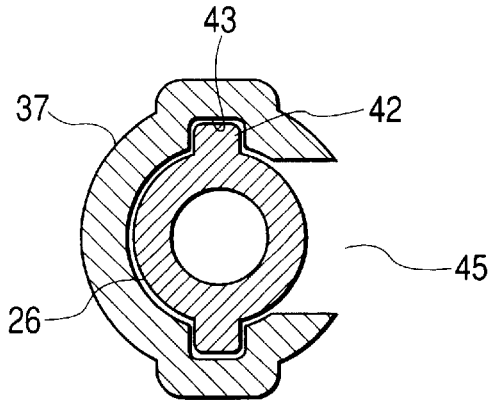
FIG. 5 is a section view taken along the line I—I shown in FIG. 4.

Now, description will be given below in more detail of the structure of the contact mechanism 34 with reference to FIGS. 4 and 5. The contact top 37 is disposed in the outer periphery of the leading end portion of the nose 26. A guide projection 42 is provided on the side surface side of the outer peripheral surface of the leading end portion of the nose 26, and is stored in the interior portion of a guide groove 43 which is formed in the inner peripheral surface of the contact top 37. The guide projection 42 extends in the longitudinal-direction of the contact top 37, and the contact top 37 is slidably guided along the axial direction of the nose 26. Owing to this structure, even in the case where an escape portion 45 is formed in the portion of the contact top 37 that corresponds to a nail-pickup inclined surface 44 formed in the lower end portion of the contact top 37, the contact top 37 can be surely guided in the axial direction of the nose 26. Therefore, in order to guide the contact top 37, there is eliminated the need for formation of a cylindrical-shaped guide portion on the lower side of the nail-pickup inclined surface 44 of the nose 26.

Figure 6:
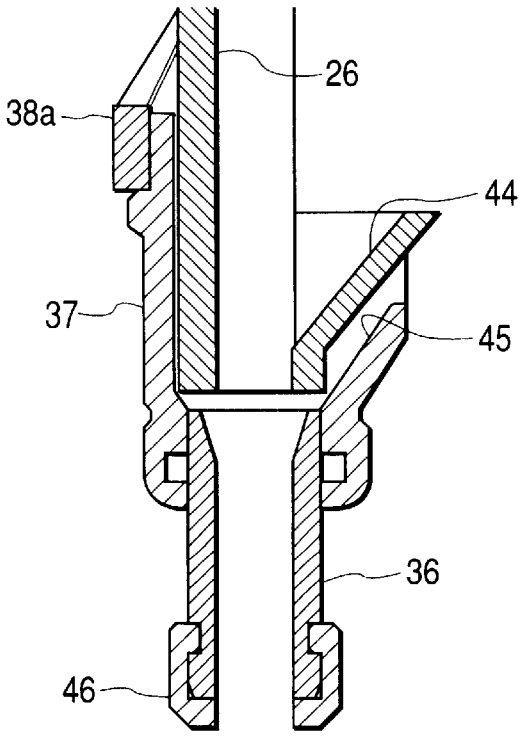
FIG. 6 is a section view of an adjuster mechanism showing a mechanism for adjustment.
Figure 7:
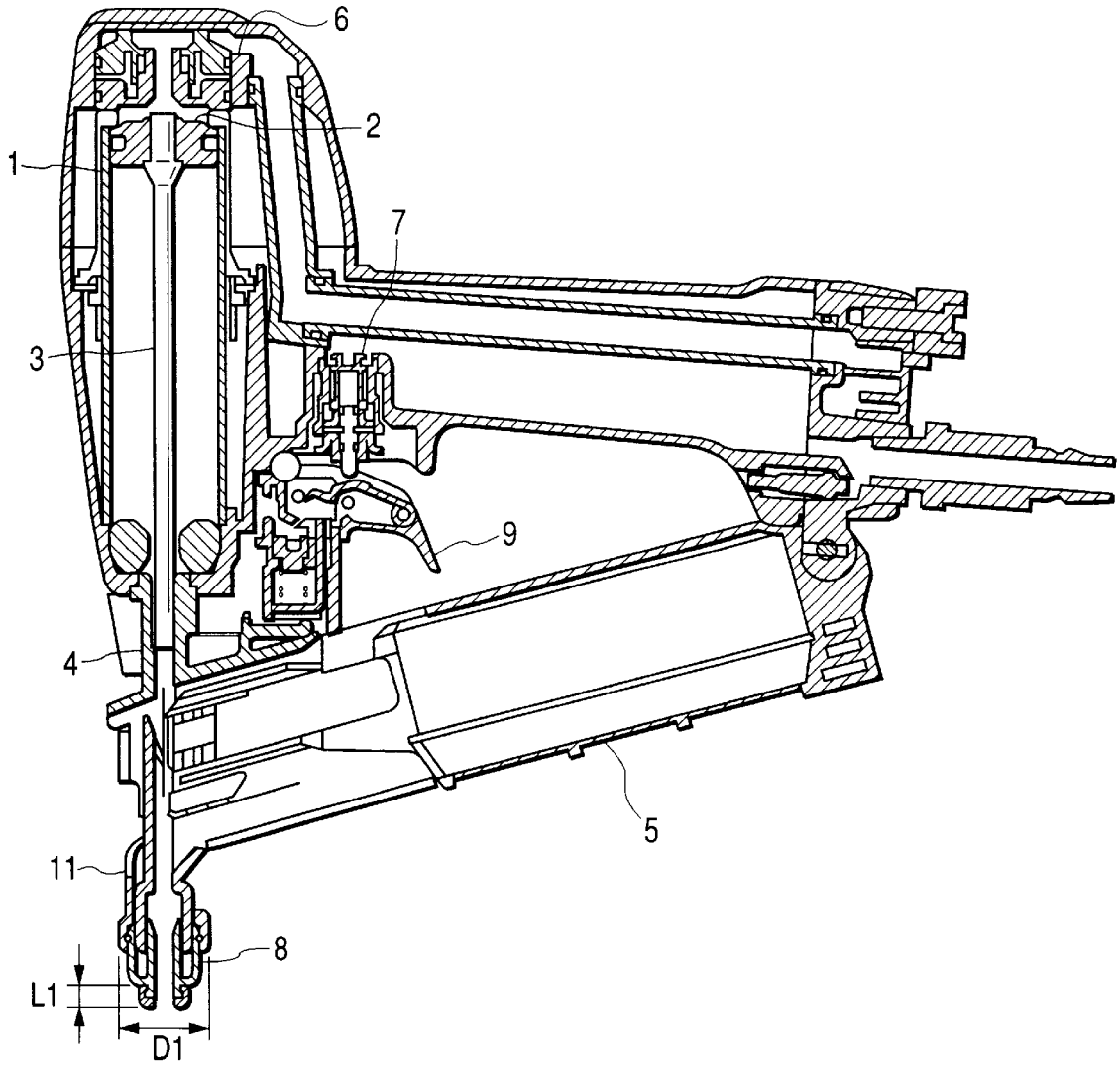
FIG. 7 is a longitudinal side view of a nailing machine incorporating therein a conventional contact mechanism.
Figure 8:
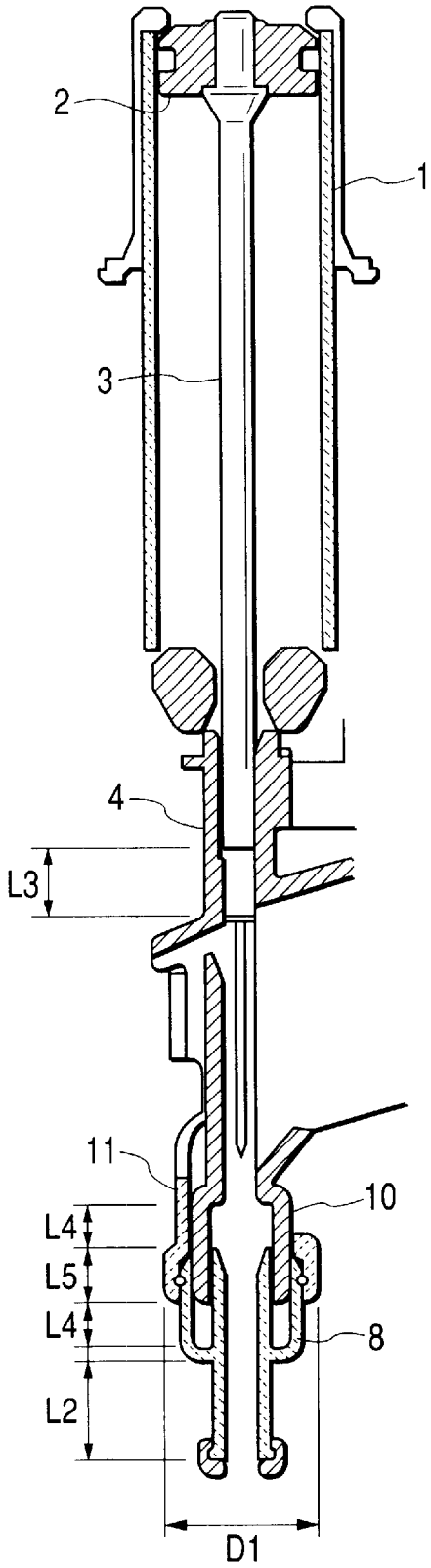
FIG. 8 is an conceptual view of the relationships between various dimensions necessary in the respective parts of the conventional nailing machine shown in FIG. 7.

As a result of this, as shown in FIG. 6, in a state where the nose top 36 is moved upwardly along the nose 26 while the nose top 36 is pressed against the member to be nailed, the escape portion 45 of the contact top 37 can be moved in such a manner that it is superimposed on the nail-pickup inclined surface 44. Since the nose top 36 and contact top 37 are guided in the axial direction of the nose 26 by the guide projection 42 and guide groove 43, the dimension of the lower side of the nail-pickup inclined surface 44 of the nose 26 can be set small, whereby the total height of the present nailing machine can be designed low.

What is claimed is:

1. A nail hammering guide mechanism in a nailing machine comprising:

a nose including a nail ejection opening;

a driver slidably disposed in an interior of said nail ejection opening for hammering a nail supplied into said nail ejection opening;

a trigger lever;

a contact mechanism disposed projectingly in front of said nose and operatable by contacting with a member to be nailed, said contact mechanism including a contact top disposed in an outer periphery of a leading end portion of said nose, and a hollow nose top having an ejection opening communicating with said nail ejection opening of said nose;

a contact arm connected to said contact top; and an adjuster mechanism connected to said contact top through said contact arm, wherein said driver can be driven through an operation of both said contact mechanism and said trigger lever, and wherein said contact top is guided by an outer peripheral surface of said leading end portion of said nose so as to be slidable along an axial direction of said nose.

2. The nail hammering guide mechanism according to claim 1, further comprising:

a guide portion disposed between said outer peripheral surface of said leading end portion of said nose and an inner peripheral surface of said contact top for slidingly guiding said nose and said contact top.

3. The nail hammering guide mechanism according to claim 2, wherein said guide portion includes:

a guide projection provided on a side surface of said outer peripheral surface of said leading end portion of said nose; and a guide groove formed in said inner peripheral surface of said contact top, wherein said guide projection is stored in an interior portion of said guide groove.

4. The nail hammering guide mechanism according to claim 1, wherein said adjuster mechanism is disposed in a middle portion of said contact arm.

5. The nail hammering guide mechanism according to claim 1, wherein said contact arm is divided into an upper arm portion and a lower arm portion by said adjuster mechanism, and wherein said adjuster mechanism includes:

a female screw;

a male screw; and an adjusting dial, wherein said lower arm portion of said contact arm is moved along said nose when said female screw and said male screw are rotated by said adjusting dial in order to adjust a projecting amount of said nose top with respect to said nose.

* * * * *